US012729543B2

(12) United States Patent
Tiirola et al.

(10) Patent No.: US 12,729,543 B2
(45) Date of Patent: Sep. 8, 2026

(54) LINING BOARD ARRANGEMENT AND METHOD FOR MOUNTING SAID ARRANGEMENT

(71) Applicant: Stofix Oy, Espoo (FI)

(72) Inventors: Samuli Tiirola, Jyvaskyla (FI); Veli-Matti Palola, Jyvaskyla (FI)

(73) Assignee: Stofix Oy, Espoo (FI)

( * ) Notice: Subject to any disclaimer, the term of this patent is extended or adjusted under 35 U.S.C. 154(b) by 281 days.

(21) Appl. No.: 18/509,477

(22) Filed: Nov. 15, 2023

(65) Prior Publication Data

US 2024/0159060 A1 May 16, 2024

(30) Foreign Application Priority Data

Nov. 16, 2022 (FI) ..... 20226028

(51) Int. Cl.
*E04F 13/08* (2006.01)

(52) U.S. Cl.
CPC ..... *E04F 13/0862* (2013.01)

(58) Field of Classification Search
CPC ..... E04F 13/0862; E04F 13/0733
See application file for complete search history.

(56) References Cited

U.S. PATENT DOCUMENTS 3,005,293 A * 10/1961 Hunter ..... E04F 13/0826 52/510
3,533,206 A 10/1970 Passeno
6,098,363 A * 8/2000 Yaguchi ..... E04F 13/14 52/387
2011/0088337 A1 4/2011 Tancredi et al.
2017/0211279 A1* 7/2017 Tiirola ..... E04F 13/0891
2022/0243481 A1* 8/2022 Freeman ..... E04F 13/142

FOREIGN PATENT DOCUMENTS

DE 202007006381 7/2007
EP 3196381 7/2017
JP 3955831 B2 * 8/2007
WO 2021005245 1/2021

OTHER PUBLICATIONS

Finnish Search Report in FI Application No. 20226028, mailed Jun. 1, 2023 (1 page).
European Search Report in EP Application No. 23209422.7-1005, mailed Apr. 18, 2024 (9 pages).

* cited by examiner

*Primary Examiner* — Brian D Mattei
(74) *Attorney, Agent, or Firm* — Leason Ellis LLP

(57) ABSTRACT

A lining board arrangement includes a lining board (100) for being mounted to a wall. The lining board (100) comprises lining tiles (110) arranged to a back-plate (120). The back-plate (120) has first positioners (128) for positioning an angle plate (200) relative to the lining board (100). The lining board arrangement comprises said angle plate (200) for being mounted to the back plate (120), wherein the angle plate (200) has second positioners (210) corresponding to the first positioners (128) of the back plate (120). A related method for mounting a lining board arrangement (10) includes the steps of: mounting a lining board (100) to a wall, positioning an angle plate (200) to the lining board (100) by means of first positioners (128) in the lining board (100) and second positioners (210) in the angle plate (200), and mounting the angle plate (200) to the lining board (100).

15 Claims, 4 Drawing Sheets

LINING BOARD ARRANGEMENT AND METHOD FOR MOUNTING SAID ARRANGEMENT

CROSS-REFERENCE TO RELATED PATENT APPLICATION

This application claims priority from Finnish Patent Application 20226028, filed Nov. 16, 2022, the entire contents of which is incorporated by reference herein as if expressly set forth in its respective entirety herein.

BACKGROUND OF THE INVENTION

The invention relates to a lining board arrangement for lining e.g. a building facade.

Furthermore, the invention relates to a method for mounting a lining board arrangement.

Building facades comprise wall sections of various lengths, on top of which, lining boards are mounted. The lining boards mountable on top of the building walls are typically manufactured and pre-assembled with specific dimensions at the factory. However, a problem is e.g. that the building facade does not match up its construction plans due to, for example, dimensional inaccuracies or manufacturing defects occurred in the construction stage, whereby the mounting of the lining boards manufactured with specific dimensions based on the construction plan may be slowed down or even prevented. Particularly, this problem occurs in buildings which comprise several walls being at an angle relative to each other, such as corners of the building or recesses formed by the windows.

BRIEF DESCRIPTION OF THE INVENTION

An object of the invention is to provide a novel lining board arrangement and a method for mounting said arrangement.

The lining board arrangement according to the invention is characterized by the lining board arrangement comprising a lining board for being mounted to a wall, wherein the lining board comprises lining tiles arranged to a back-plate. The back-plate has first positioners for positioning an angle plate relative to the lining board. The lining board arrangement further comprises said angle plate for being mounted to the back-plate, wherein the angle plate has second positioners corresponding the first positioners of the back-plate.

The method for mounting a lining board arrangement according to the invention is characterized by mounting the lining board to a wall, positioning an angle plate to the lining board by means of first positioners in the lining board and second positioners in the angle plate, and attaching the angle plate to the lining board.

In the presented lining board arrangement, lining boards and lining tiles manufactured with specific dimensions at the factory are made to correspond to the actual dimensions of the building walls, which may comprise dimensional inaccuracies created in the construction stage. The lining board arrangement is made to correspond to the actual dimensions of the building wall by means of the lining board and the angle plate being mounted to it, wherein the angle plate is positioned at a determined position relative to the lining board by means of the first positioners in the lining board and the second positioners in the angle plate. Said positioners enable the quick and accurate positioning of the angle plate to the lining board.

Some embodiments of the invention are presented in the dependent claims.

BRIEF DESCRIPTION OF THE FIGURES

The invention is now described in closer detail in connection with preferred embodiments and with reference to the accompanying drawings, in which.

For reasons of clarity, some embodiments of the invention are illustrated in the figures in a simplified form. In the figures, like reference numerals identify like elements.

DETAILED DESCRIPTION OF THE INVENTION

Figure 1A:
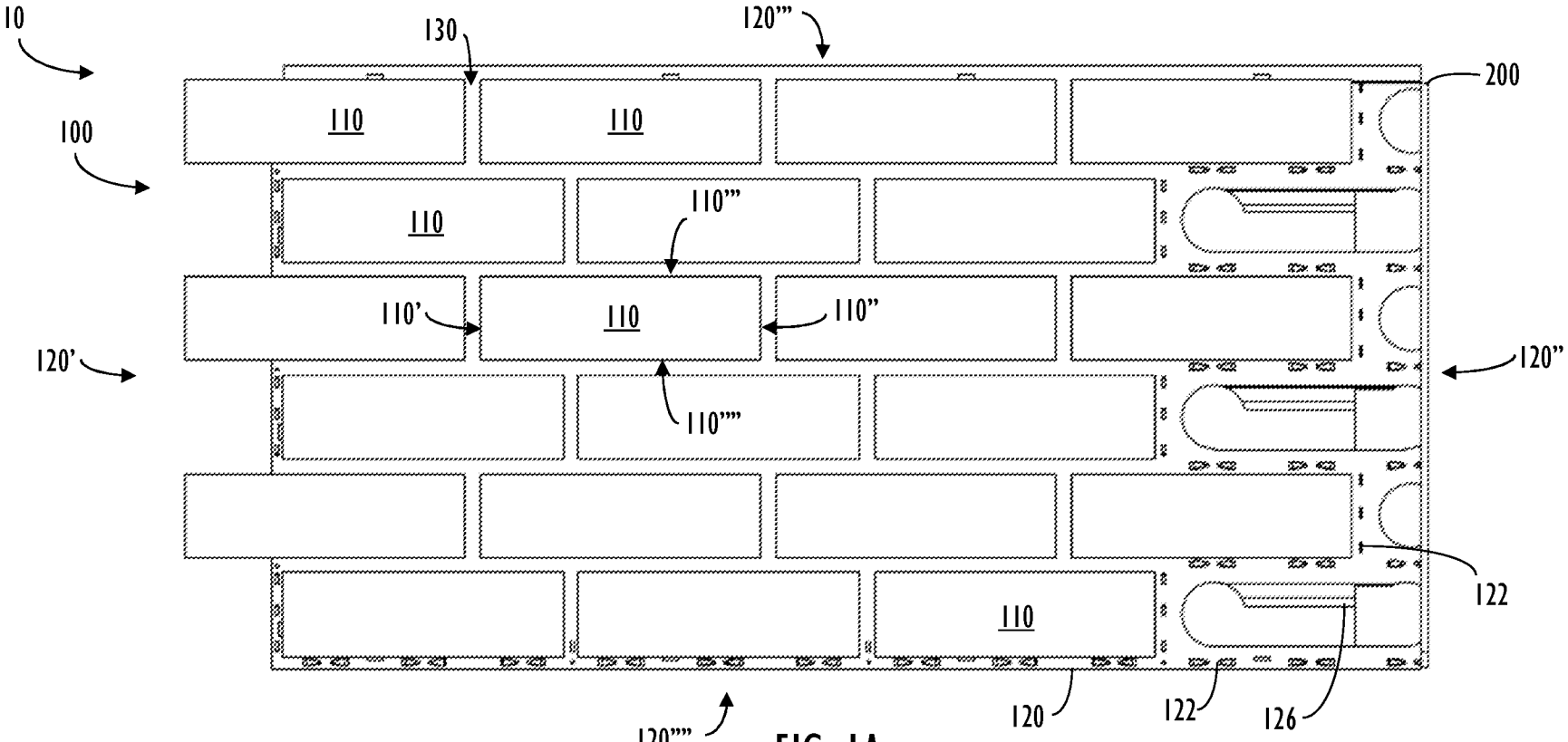
FIG. 1A is a schematic front view of a lining board arrangement.
Figure 1B:
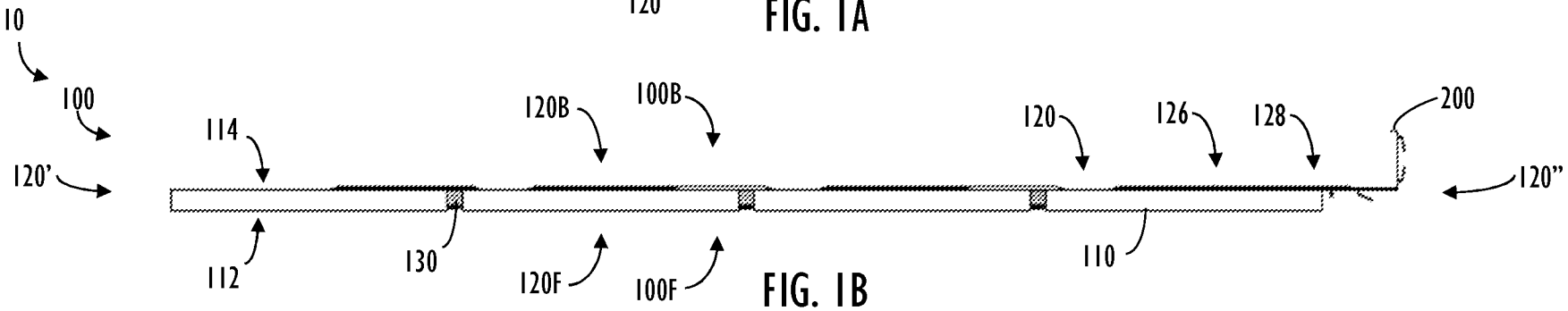
FIG. 1B is a schematic top view of the lining board arrangement of FIG. 1A.
Figure 1C:
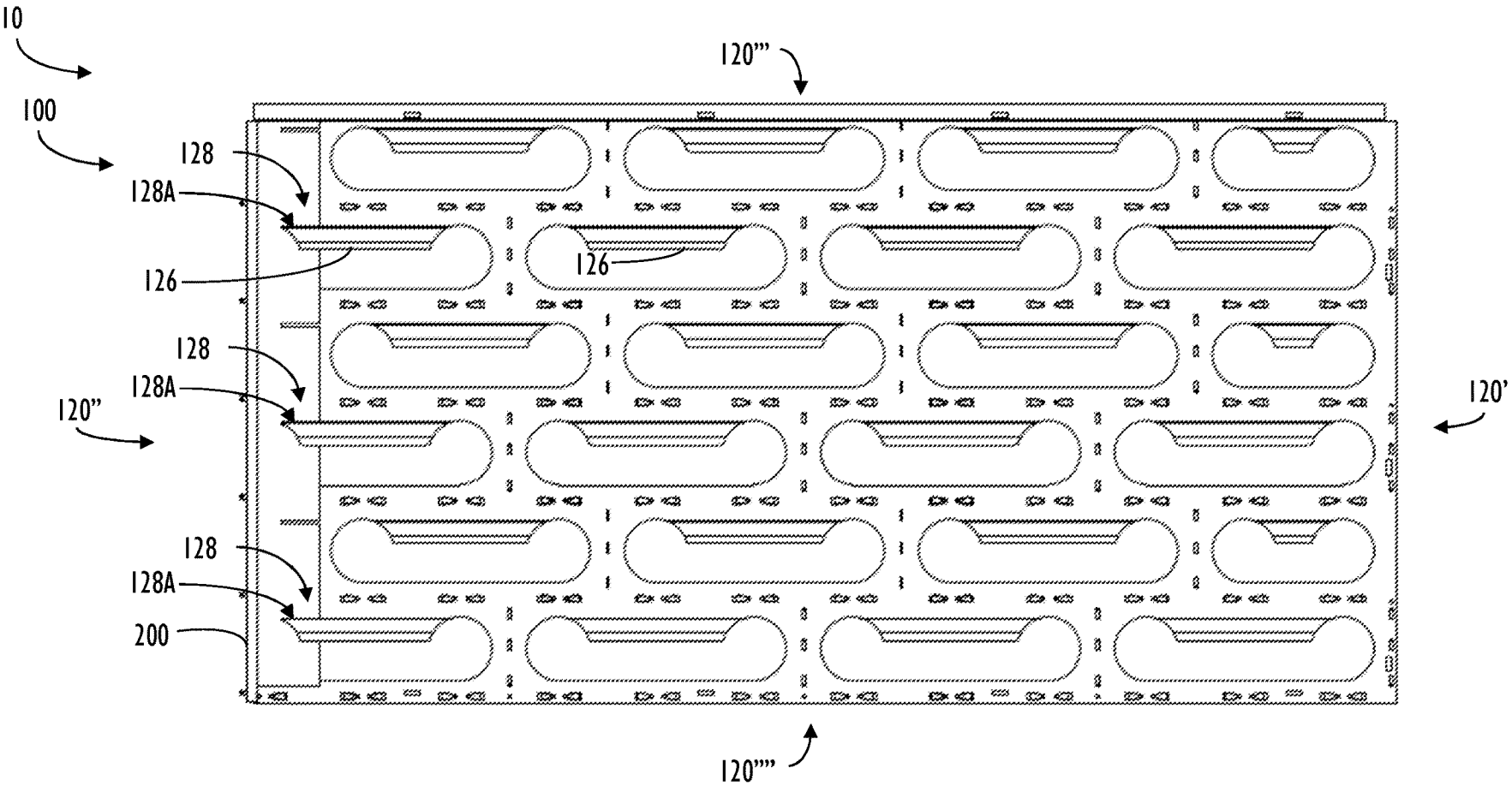
FIG. 1C is a schematic view of the lining board arrangement of FIG. 1A seen from the direction of the back.
Figure 2A:
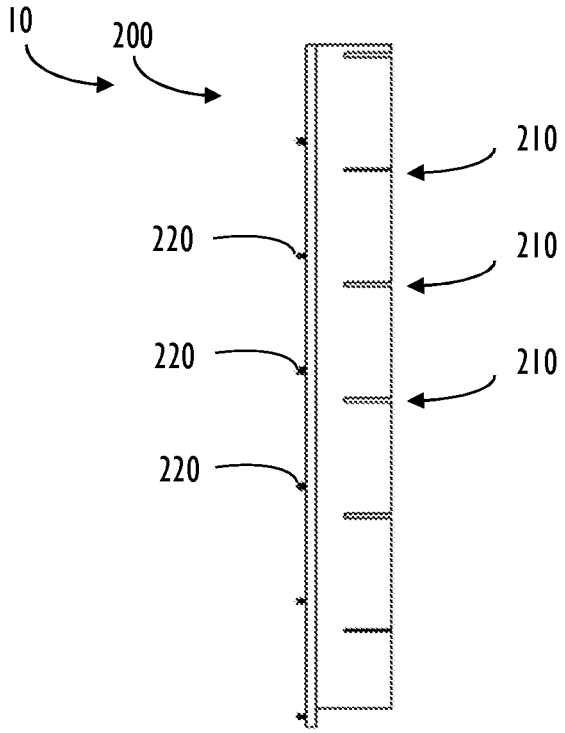
FIG. 2A is a schematic side view of an angle plate of a lining board arrangement.
Figure 2C:
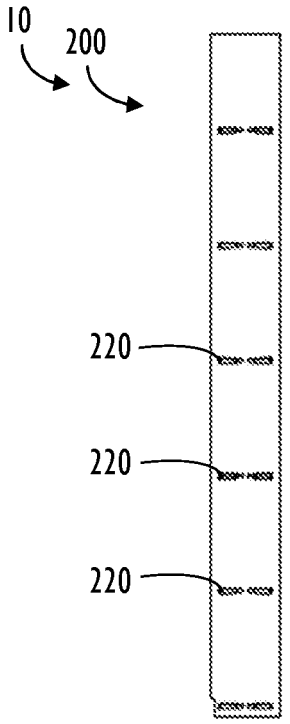
FIG. 2C is a schematic view of the angle plate of the lining board arrangement of FIG. 2A seen from the direction of one side.
Figure 2B:
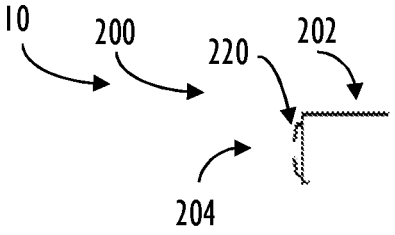
FIG. 2B is a schematic top view of the angle plate of FIG. 2A.
Figure 3:
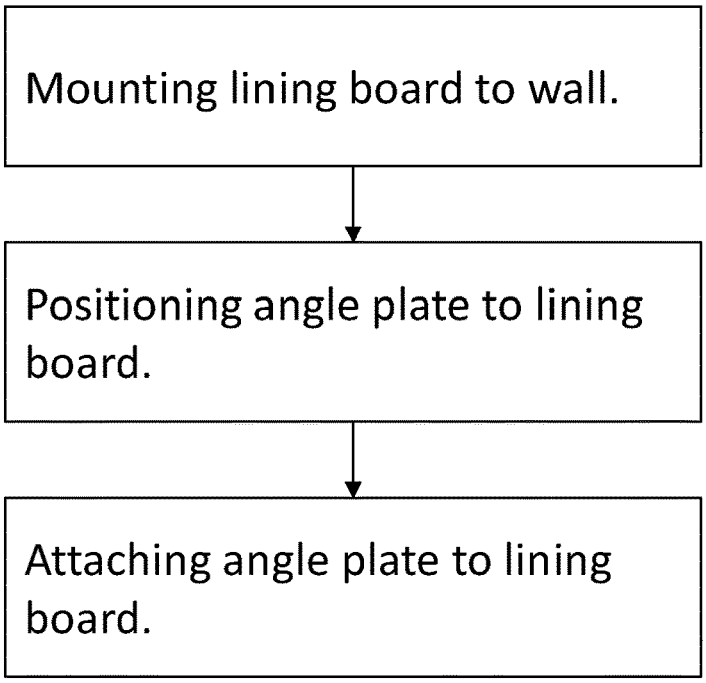
FIG. 3 is a schematic view of a method for mounting the lining board arrangement of FIG. 1A.
Figure 4:
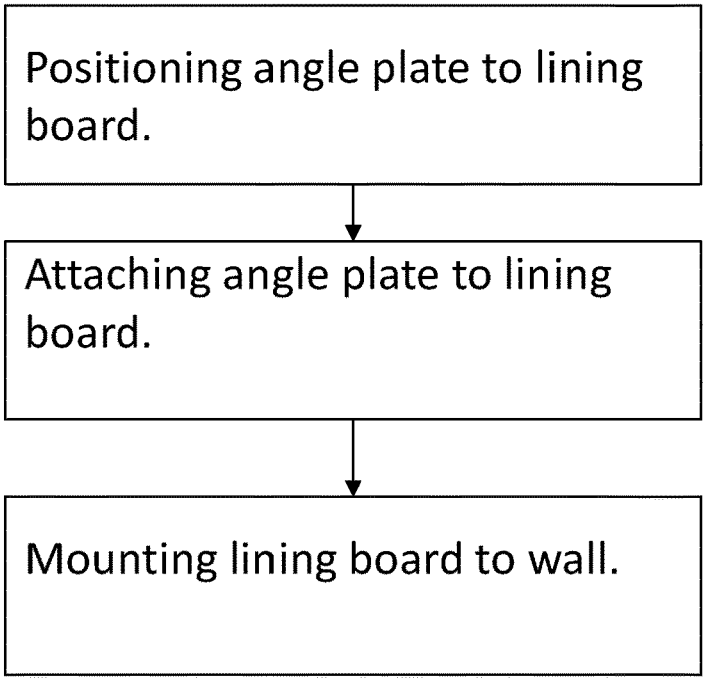
FIG. 4 is a schematic view of another method for mounting the lining board arrangement of FIG. 1A.

FIG. 1A is a schematic front view of a lining board arrangement. FIG. 1B is a schematic top view of the lining board arrangement of FIG. 1A. FIG. 1C is a schematic view of the lining board arrangement of FIG. 1A seen from the direction of the back. FIG. 2A is a schematic side view of an angle plate of a lining board arrangement. FIG. 2B is a schematic top view of the angle plate of FIG. 2A. FIG. 2C is a schematic view of the angle plate of the lining board arrangement of FIG. 2A seen from the direction of one side. FIG. 3 is a schematic view of a method for mounting the lining board arrangement of FIG. 1A. FIG. 4 is a schematic view of another method for mounting the lining board arrangement of FIG. 1A.

A lining board arrangement 10 of FIGS. 1A-C comprises a lining board 100 for being mounted to a wall of a building, whereby the facade of the building may be formed by mounting several lining boards 100 of FIGS. 1A-C on the building wall side by side in both the horizontal and vertical direction of the building wall. The lining board 100 comprises a back-plate 120 and lining tiles 110 arranged to the back-plate 120. The lining board arrangement 10 further comprises an angle plate 200 for being mounted to the lining board 100. The lining board arrangement 10 is intended to be located near the wall sections of the building being at an angle relative to each other, such as near the window recesses of the building or the corners of the building, such that the angle plate 200 is located on both sections of the wall section being at an angle relative to each other. The lining tiles 110 are mounted to the back-plate 120 and/or the angle plate 200 by an adhesive mass 130.

The lining tile 110 of FIGS. 1A-C has a facade surface 112 which forms part of a facade side 100F of the lining board 100 visible to the outside. In the examples of the figures, the lining tiles 110 are of rectangular shape, wherein the lining tile 110 has a specific length and a specific height. The length of the lining tile 110 may be e.g. 50-400 mm, preferably e.g. 285 mm, and its height may be e.g. 50-400 mm, preferably e.g. 85 mm. However, the size and appearance of the lining tiles 110 may vary in many different ways. The lining tile 110 may be e.g. a brick tile, a burned brick tile, a cut brick tile, a lining stone tile, a plastic tile, or a clinker tile.

Furthermore, the lining tile 110 of the lining board 100 has a back surface 114 which is located on the opposite side from the facade surface 112 of the lining board 110. The back surface 114 of the lining board 110 is arranged to be positioned against a front surface 120F of the back-plate 120 or near the front surface 120F of the back-plate 120, wherein the back-plate 120 will be later described in more detail.

Furthermore, the lining tile 110 of the lining board 100 has side faces 116'-116"" between the facade surface 112 and the back surface 114. The lining tile 110 has a determined thickness, which may be e.g. 10-45 mm, preferably about 20 mm. The lining tiles 110 are fixed from their side faces 110'-110"" to an adhesive mass 130 and, via the adhesive mass 130, to the back-plate 120.

The back-plate 120 of the lining board 100 of the lining board arrangement 10 of FIGS. 1A-C may be e.g. a steel plate. The back-plate 120 has a front surface 120F directed in the direction of the facade side 100F of the lining board 100 and, on the opposite side, a back surface 120B directed at the building wall. The back-plate 120 is of substantially rectangular shape, and it has a first side face 120', a second side face 120", a third side face 120''', and a fourth side face 120"" between the facade side 100F of the lining board 100 and the back side 100B of the lining board 100, or in other words, a first side face 120', a second side face 120", a third side face 120''', and a fourth side face 120"" between the front surface 120F and the back surface 120B of the back-plate 120. In the lining board 120, the first side face 120' and the second side face 120" are additionally side faces oriented substantially in opposite directions relative to each other, i.e. side faces oriented away from each other, as are the third side face 120''' and the fourth side face 120"" side faces oriented substantially in opposite directions relative to each other, i.e. side faces oriented away from each other. In the back-plate 120, the first side face 120' and the second side face 120" form the end surfaces or end edges of the back-plate, the third side face 120''' forms the upward directed upper surface or upper edge of the back-plate 120, and the fourth side face 120" forms the downward directed lower surface or lower edge of the back-plate 120.

Furthermore, the back-plate 120 includes grippers 122, which are protrusions pointing in the direction of the facade side 100F of the lining board 100, or in other words, protrusions pointing in the direction shown by the front surface 120F of the back-plate 120. The grippers 122 are located in the back-plate 120 in an arranged manner such that the side faces 110'-110"" of the lining tiles 110 for being mounted to the back-plate are positioned near the grippers 122. Said grippers 122 may be separately mounted to the back-plate 120, but more preferably said grippers 122 are fixed portions of the back-plates 120 and formed of the back-plate 120, for example, by punching said portion with the exception of one edge off the back-plate 120 and by bending it in the shape of a protrusion of the desired shape. The gripper 122 is configured, in a manner to be described later in more detail, to the adhesive mass 130, whereby the lining tiles 110 are fixed via the grippers 122 and the adhesive mass 130 to the back-plate 120.

Furthermore, the back-plate 120 includes hangers 126, from which, the lining board 100 is configured to be mounted for supporting hanging rails mounted to the building wall. The hangers 126 are protrusions oriented in the direction of the back side 100B of the lining board 100 or i.e. oriented away from the back surface 114 of the lining tile 110, or in other words, protrusions directed into a direction determined by the back surface 120B of the back-plate 120. Said hangers 126 may be separately fixed to the back-plate 120, but more preferably said hangers 126 are fixed portions of the back-plates 120 and formed of the back-plate 120, for example, by punching said portion with the exception of one edge off the back-plate 120 and by bending it in the shape of a protrusion of the desired shape. The hanger 126 formed of the back-plate 120 may comprise e.g. a protrusion first extending vertically away from the back surface 120B of the back-plate 120, from which, the protrusion continues as folded downward partially toward the lower edge 120"" of the back-plate, from which, the protrusion further extends still folded downward parallel with the back-plate 120 towards the lower edge 120" of the back-plate.

Furthermore, the back-plate 120 includes first positioners 128 which are protrusions located on the back side 120B of the back-plate 120 which are located in a determined position near the first side face 120' and/or the second side face 120" if the back-plate 120. The first positioners 128 may be oriented in the direction of the back side 100B of the lining board 100, or in other words, protrusions oriented away from the lining tile 110. Said first positioners 128 may be separately fixed to the back-plate 120, but more preferably said first positioners 128 are fixed portions of the back-plates 120 and formed of the back-plate 120, for example, by punching said portion with the exception of one edge off the back-plate 120 and by bending it in the shape of a protrusion of the desired shape. The first positioners 128 align the angle plate 200 in the height direction of the upper edge 120''' and the lower edge 120"" of the back-plate 120 when assembling the lining board arrangement 10.

Furthermore, in the embodiment of FIGS. 1A-C, the first positioners 128 have a plane surface 128A preferably substantially vertical relative to the back surface 120B of the back-plate 120, which allows the positioning of the angle plate 200 at a determined distance from the back surface 120B of the back-plate 120 in a direction determined by the plane surfaces 128A in the first positioners 128 when assembling the lining board arrangement 10. Said determined distance may be e.g. 0-20 mm, preferably 0-5 mm.

Furthermore, in the embodiment of FIGS. 1A-C, the first positioners 128 are integrated into said hangers 126 which are located near the first side face 120' and/or the second side face 120" of the back-plate 120, whereby the hangers 126 thus located near the first side face 120' and/or the second side face 120" of the back-plate 120 are configured to operate as hangers 126 and a section of the hangers 126 is configured to operate as the first positioners 128. In the embodiment of FIGS. 1A-C, the section of the plane surface of the hanger 126, which is located vertically relative to the back surface 120B of the back-plate 120, is configured to operate as the first positioner 128.

The angle plate 200 of the lining board arrangement 10 of the figures, such as e.g. a bent steel plate, is intended for being mounted on the back side 120B of the back-plate 120 of the back-plate 120 of the lining board 100, wherein the angle plate 200 is located near the first side face 120' or the second side face 120" of the back-plate 120. In FIGS. 2A-C, the angle plate 200 is shown separate from the lining board 100 for clarity.

Furthermore, the lining board 100 of the lining board arrangement 10 and the angle plate 200 to be mounted to it are intended to be located in the wall sections of the building being at an angle relative to each other, such as to the window recesses or the corners of the building. To the angle plates 200 to be located to window recesses are mounted i.e. positioned and fixed typically lining tiles 110 for forming a facade in the window recess. The lining tiles 100 to be located on both sides of the building corners are mounted i.e. positioned and fixed relative to each other by means of the angle plate 200.

Furthermore, the angle plate 200 of the figures comprises second positioners 210 corresponding to the first positioners 128 of the back-plate 120. The angle plate 200 comprises a first side 202 where said second positioners 210 are located. Said second positioners 210 may be mounted to the angle plate 200 separately but, more preferably, said positioners 210 are fixed sections of the angle plate 200 and formed in the angle plate 200, wherein the second positioner 210 is a slot 210 having an open end, or an elongated slot 210 having an open end, on the first side 202 of the angle plate. The slot having an open end or the elongated slot having an open end allows the positioning of the angle plate 200 in a determined position relative to the first side face 120' or the second side face 120" of the back-plate 120 when assembling the lining board arrangement 10.

Furthermore, in the embodiment of the figures, the angle plate 200 includes grippers 220. The angle plate 200 comprises a second side 204 where said grippers 220 are located. The grippers 220 are protrusions oriented away from the plane surface formed by the second side 204 into the direction of the lining tiles 110 to be mounted, or in other words, the protrusions are directed away from the wall or window recess of the building. The angle plate 200 of the figures is used in window recesses which are lined with lining tiles 110. Said grippers 220 may be separately mounted to the angle plate 200, but more preferably said grippers 220 are fixed portions of the angle plates 200 and formed of the angle plate 200, for example, by punching said portion with the exception of one edge off the angle-plate 200 and by bending it in the shape of a protrusion of the desired shape. The gripper 220 is configured to grip the adhesive mass 130 for mounting the lining tile 110 to the back-plate 120.

In an embodiment, instead of the grippers 220 in the angle plate 200, the angle plate 200 includes third positioners on the second side 204 of the angle plate 200. Said third positioners are not shown in the figures. Said embodiment is used when the angle plate 200 is located in the corner of the building, wherein two adjacent lining boards 100 located on both sides of the corner are positioned and fixed relative to each other. The construction of the third positioners is equivalent to that of the above-mentioned second positioners 210, but the third positioners are configured to correspond to the second lining board 100, or in more detail, to the positioners 128 of the second lining board 100, and thus to align the lining board 100 corresponding to the angle plate 200 relative to each other.

In an embodiment, the second side 204 of the angle plate 200 does not comprise grippers 220 nor third positioners, but the second side 204 is configured to operate as a protective plate of the window recess, wherein no lining tiles 110 nor second lining board 100 is thus mounted to the angle plate 200.

The lining board 100 is manufactured as follows. The lining tiles 110 are positioned on a manufacturing platform with their facade surfaces 112 facing down, at a distance from each other determined by a desired gap. In said positioning, a meshy panel guide, for example, may be utilised, having longitudinal and transverse rods that define the mutual positioning of the lining tiles 110. When a panel guide is used, the lining tiles 110 may be put in place either by hand or automatically with the aid of a robot, for example. Alternatively, the positioning of the lining tiles 110 may be carried out automatically without a special panel guide by means of a robot, only.

When the specified lining tiles 110 included in the lining board 100 to be manufactured have been set in place, adhesive mass 130 is fed onto the side faces 110'-110"" of the adjacent lining tiles 110, wherein said adhesive mass 130, as it is curing, fixes the adjacent lining tiles 110 to each other. The lining tiles 110 may comprise sockets on the sides 110'-110' of the lining tile, on the back side of the lining tile 110, in which the adhesive mass is fed, wherein the socket and the adhesive mass fed to it enable the mounting of the lining tiles very near each other. Said sockets are not shown in the figures and they will not be discussed here in more detail.

Before the adhesive mass 130 cures, the back-plate 120 is put in place such that the grippers 122 are positioned between the lining tiles 110, where the adhesive mass 130 is located, whereby the grippers 122 thus grip to the adhesive mass 130. In such a case, the adhesive mass 130, as it is curing, secures the tiling formed by the lining tiles 110 to the back-plate 120 through the adhesive mass 130 and the grippers 122, the back-plate 120 forming a frame structure of the lining board 100.

As adhesive mass 130, cement-based grout, cement or epoxy based jointing mortars or plastic pastes may be used. To mount brick and lining brick panels, grout, jointing mortars, or plastic pastes may be used. Plastic pastes may be best suited for mounting plastic panels, but the use of grout or jointing mortar to mount plastic panels is also possible.

In the manufacture of the lining board 100, a part of the lining tiles 110 may be left unmounted, wherein particularly a part of the lining tiles 110 of the lining board 100 to be positioned at an angle of the window recess or the corner of the building may be left unmounted. For example, FIG. 1A shows the embodiment in question wherein a part of the lining tiles 110 have been left unmounted on the second side face 120" of the back-plate 120. Particularly, the lining tiles 110 being located near the first side face 120' and/or the second side face 120" of the back-plate 120 are left unmounted at the factory, if an angle plate 200 will be mounted closed to said side face 120',120', and the lining tiles 110 are mounted to the lining board 100 at the construction site after the angle plate 200 has been mounted to the lining board 100. For example, the lining tiles 110 to be located to window recesses and the lining tiles 110 of the lining board 100 being at an angle relative to them may then be located specifically relative to each other in the mounting stage considering dimensional inaccuracies created in the construction stage of the building or, for example, the lining tiles 110 of the lining board 100 to be located on both sides of the corner of the building may then be located specifically relative to each other considering dimensional inaccuracies created in the construction stage of the building.

The lining board arrangement 10 is mounted as follows in accordance with a method. The lining boards 100 and the angle plates 200 are manufactured at a factory. The lining boards 100 and the angle plates 200 are transported to a mounting site. The lining tiles 110 are transported to the mounting site.

Furthermore in the mounting stage, hanging rails, to which the hangers 126 of the lining board 100 correspond, are mounted to the walls of the building. The lining board 100 is set by its hangers 126 to be supported by the hanging rails on the wall of the building.

Furthermore in the mounting stage, the angle plates 200 are positioned to those lining boards 100 which are located near the window recesses or corners of the building. The angle plate 200 is positioned to the lining board 100 such that the second positioners 210 of the angle plate 200 correspond to the first positioners 128 of the back-plate 120, whereby the angle plate 200 retains its vertical position relative to the lining board 100. The angle board 200 is positioned relative to the corner or the window recess of the building such that the angle plate 200 is specifically in line with the angle in the building, whereby the angle plate 200 is further in a determined position relative to the first side face 120' or the second side face 120" of the back-plate 120.

Furthermore in the mounting stage, the angle plate 200 positioned to the lining board 100 is attached to the lining board 100 e.g. by an adhesive material, i.e. installation adhesive, and/or mounting members, such as e.g. drill screws. The adhesive is located between the angle plate 200 and the lining board 100, whereby the angle plate 200 is fixed to the lining board 100. The mounting members may, depending on the situation, be mounted from the facade side 100F or the back side 100B of the lining board 100.

Furthermore in the mounting stage, the lining tiles 110 are fixed to the angle plate 200 by an adhesive mass 130 before mounting the angle plate 200 and/or after having mounted the angle plate 200 to the lining board 100. The lining tiles 110 having possibly left unmounted in the manufacturing stage of the lining board 100 are mounted in the same mounting stage with the lining tiles 110 for being fixed to the angle plate 200, whereby the unmounted lining tiles 110 may be positioned specifically relative to the lining tiles 110 to be located to the angle plate 200 considering e.g. dimensional inaccuracies created in the construction stage of the building. It is possible to cut the lining tiles 110 to be mounted to the lining board 100 and the angle plate 200 to specific size before mounting them to the lining board 100 or the angle plate 200.

According to another method, the mounting order of the mounting stage is as follows. The lining boards 100 and the angle plates 200 are manufactured and transported to a mounting site. The lining tiles 110 are transported to the mounting site. Said hanging rails are mounted on the walls of the building. The angle plate(s) 200 is/are positioned and attached to the lining board 100, wherein the position of the angle plate 200 relative to the first side 120' and/or the second side 120" of the back-plate 120 is determined in a specified manner, such as e.g. based on the measurement of the building. The lining tiles 110 are fixed to the angle plate 200 by an adhesive mass 130 before mounting and/or after having mounted the angle plate 200 to the lining board 100. The lining tiles 110 having possibly left unmounted in the manufacturing stage of the lining board 100 are also mounted in this stage, and it is possible to cut the lining tiles 110 to be mounted to the lining board 100 to specific size before mounting them to the lining board 100. The lining board 100, to which is mounted the angle plate 200, is mounted to be supported by the hanging rails mounted to the building wall by the hangers 126 of the lining board 100.

If necessary, it is possible to cut the lining tiles 110 to specific size before mounting them to the lining board 100 or the angle plate 200 to consider the dimensional inaccuracies created in the construction stage of the building. The position of the angle plate 200 relative to the lining board 100 is determined at the mounting site, wherein possibly cut-to-size lining tiles 110 are mounted in place of the lining tiles 110 unmounted to the lining board 100, the size being based on the position of the angle plate 200 relative to the lining board 100.

It is possible to cut the lining boards 100 to size, if necessary, from the first side 120' or the second side 120" of the lining board 100 before mounting and/or after having mounted the lining board 100 to the wall.

Those skilled in the art will find it obvious that, as technology advances, the basic idea of the invention may be implemented in many different ways. The invention and its embodiments are thus not restricted to the examples described above but may vary within the scope of the claims.

The invention claimed is:

1. A lining board arrangement, which comprises a lining board for being mounted to a wall, wherein the lining board comprises lining tiles arranged to a back-plate, the back-plate comprising grippers arranged in the back-plate such that side faces of the lining tiles are positioned near the grippers, wherein the lining tiles are fixed via the grippers and an adhesive mass to the back-plate, wherein the back-plate has first positioners for positioning an angle plate relative to the lining board, and wherein the lining board arrangement further comprises said angle plate for being mounted to the back-plate, wherein the angle plate has second positioners corresponding to the first positioners of the back-plate, wherein the side faces of the lining tile are located between the facade surface and the back surface, wherein the angle plate is mounted to the back plate by an interaction between the first positioners and the second positioners.

2. The lining board arrangement as claimed in claim 1, wherein at least the lining tiles to be mounted near a second side face of the lining board are configured to be mounted when assembling the lining board arrangement.

3. The lining board arrangement as claimed in claim 1, wherein the first positioners being in the back-plate of the lining board are brackets aligned outwards from the lining board, which brackets align the angle plate in a vertical direction between an upper edge and a lower edge of the back-plate when assembling the lining board assembly.

4. The lining board arrangement as claimed in claim 3, wherein the first positioners being in the back-plate of the lining board comprises a plane surface being perpendicular relative to the back-plate, which plane surface allows the angle plate to be aligned in a determined position relative to a back surface of the back-plate in a direction of the plane surface being in the first positioners when assembling the lining board arrangement.

5. The lining board arrangement as claimed in claim 1, wherein the second positioners in the angle plate are elongated slots having open ends locating at an end of the angle plate to allow the back-plate to be aligned in a determined position relative to the side face of the back-plate when assembling the lining board arrangement.

6. The lining board arrangement as claimed in claim 3, wherein the back-plate has hangers for hanging the lining board arrangement to said wall, and wherein said first positioners are integrated to said hangers.

7. A method for mounting a lining board arrangement, the method comprising mounting the lining board to a wall, wherein the lining board comprises lining tiles arranged to a back-plate, the back-plate comprising grippers arranged in the back-plate such that side faces of the lining tiles are positioned near the grippers, wherein the lining tiles are fixed via the grippers and an adhesive mass to the back-plate, wherein the back-plate has first positioners for positioning an angle plate relative to the lining board, positioning an angle plate to the lining board by means of the first positioners in the lining board and second positioners in the angle plate, and attaching the angle plate to the lining board by an interaction between the first positioners and the second positioners, and the side faces of the lining tile are located between the facade surface and the back surface.

8. A method for mounting a lining board arrangement, the method comprising positioning the angle plate to the lining board by means of first positioners in the lining board and second positioners in the angle plate, wherein the lining board comprises lining tiles arranged to a back-plate, the back-plate comprising grippers arranged in the back-plate such that side faces of the lining tiles are positioned near the grippers, wherein the lining tiles are fixed via the grippers and an adhesive mass to the back-plate, wherein the back-plate has first positioners for positioning an angle plate relative to the lining board, wherein the angle plate has second positioners, attaching the angle plate to the lining board by an interaction between the first positioners and the second positioners, and mounting the lining board to a wall, and wherein the side faces of the lining tile are located between the facade surface and the back surface.

9. A method as claimed in claim 7 for mounting a lining board arrangement, the method further comprising fixing the lining tiles to the angle plate with an adhesive mass.

10. A method as claimed in claim 7 for mounting a lining board arrangement, the method further comprising mounting lining tiles to the mounted angle plate by an adhesive mass.

11. A method as claimed in claim 9 for mounting a lining board arrangement, the method further comprising fixing lining tiles cut to specific size to the lining board, the specific size being based on the position of the angle plate relative to the lining board.

12. A method as claimed in claim 7 for mounting a lining board arrangement, the method further comprising mounting a second lining board to the angle plate fixed to the lining board by means of third positioners in the angle plate, which third positioners correspond to the first positioners in said second lining board.

13. A method as claimed in claim 12 for mounting a lining board arrangement, the method further comprising fixing lining tiles cut to specific size to the lining boards being at an angle relative to each other, the specific size being based on the position of the angle plate relative to the lining board.

14. A method as claimed in claim 8 for mounting a lining board arrangement, the method further comprising fixing the lining tiles to the angle plate with an adhesive mass.

15. A method as claimed in claim 14 for mounting a lining board arrangement, the method further comprising fixing lining tiles cut to specific size to the lining board, the specific size being based on the position of the angle plate relative to the lining board.

* * * * *